US007069980B2

(12) United States Patent
Hofbauer

(10) Patent No.: US 7,069,980 B2
(45) Date of Patent: Jul. 4, 2006

(54) SERPENTINE, MULTIPLE PATHS HEAT EXCHANGER

(75) Inventor: Karl Hofbauer, Frickenhausen (DE)

(73) Assignee: Modine Manufacturing Company, Racine, WI (US)

( * ) Notice: Subject to any disclaimer, the term of this patent is extended or adjusted under 35 U.S.C. 154(b) by 225 days.

(21) Appl. No.: 10/684,934

(22) Filed: Oct. 14, 2003

(65) Prior Publication Data

US 2004/0194934 A1 Oct. 7, 2004

(30) Foreign Application Priority Data

Oct. 18, 2002 (DE) ..... 102 48 665

(51) Int. Cl.
*F28D 1/047* (2006.01)

(52) U.S. Cl. ..... 165/150; 165/144; 165/174; 165/176

(58) Field of Classification Search ..... 165/150, 165/152, 153, 144, 174, 176
See application file for complete search history.

(56) References Cited

U.S. PATENT DOCUMENTS 2,657,018 A * 10/1953 Simpelaar ..... 165/170
4,615,383 A 10/1986 Hisao
5,036,909 A 8/1991 Whitehead et al.
5,197,539 A * 3/1993 Hughes et al. ..... 165/172
5,314,013 A * 5/1994 Tanabe ..... 165/176
5,368,097 A 11/1994 Chiba et al.
5,682,944 A * 11/1997 Yamamoto et al. ..... 165/110
5,875,837 A * 3/1999 Hughes ..... 165/140
2003/0102112 A1* 6/2003 Smithey et al. ..... 165/150

FOREIGN PATENT DOCUMENTS

DE 100 49 256 A1 4/2002
EP 0 374 895 * 6/1990
JP 57-73392 * 5/1982
JP 61-1994 * 1/1986
JP 63-6392 * 1/1988
JP 6-317363 11/1994

* cited by examiner

*Primary Examiner*—Teresa J. Walberg
(74) *Attorney, Agent, or Firm*—Wood, Phillips, Katz, Clark & Mortimer

(57) ABSTRACT

A serpentine, multiple pass heat exchanger includes at least one flattened, multiple port tube in serpentine configuration with a plurality of general parallel runs defining at least three hydraulically separate flow paths fins. Fins extend between and are in thermal conducting relation with adjacent ones of the runs and an inlet manifold is located on one end of the tubes with an outlet manifold located on the other. A baffle is located in the outlet manifold and the inlet manifold includes a partition which extends both longitudinally and transversely within the inlet manifold to hydraulically separate one flow path from the inlet port while connecting other flow paths to each other to provide for multiple passes.

10 Claims, 5 Drawing Sheets

SERPENTINE, MULTIPLE PATHS HEAT EXCHANGER

FIELD OF THE INVENTION

This invention relates to heat exchangers, and more particularly, to a serpentine heat exchanger having multiple passes.

BACKGROUND OF THE INVENTION

Serpentine heating exchangers are well known and typically include at least one flattened, multiple port tube, usually of extruded configuration, bent into a serpentine configuration to have a plurality of parallel runs where fins, generally serpentine fins, extend between adjacent ones of the parallel runs. These serpentine heat exchangers are most typically employed in two phase heating exchange as, for example, in refrigeration systems (including air conditioning systems) wherein a refrigerant passing through the tube changes phase. When used as an evaporator, the refrigerant evaporates from the liquid phase to the gaseous phase and where employed as a condenser or gas cooler, the refrigerant changes from the gaseous phase to or toward the liquid phase. Typical examples are illustrated in U.S. Pat. Nos. 5,368,097 and 5,036,909. Examples may also be seen in Japanese patent document 6-317363 of Nov. 15, 1994 and German patent document DE10049256A1. Reference may also be made to Japanese patent document JP06317363A.

In the German heat exchanger, special flow guiding locations are provided to convey the internal heat transfer medium from a rear cooling branch to a front cooling branch, the guiding configurations being individual tubes into which the ends of two cooling branches or sections constructed from two multiple channel flat tubes communicate. A gaseous heat exchange medium flows through several of the cooling branches arranged one behind the other in the same direction and while the construction works well for its intended purpose, manufacture can be difficult in terms of fitting the components that provide the guiding function to the apparatus.

The heat exchanger shown in U.S. Pat. No. 5,036,909 is intended for use as an evaporator in an air conditioner. This heat exchanger utilizes a separate tube to guide the refrigerant from a cooling branch in the inlet side to two subsequent cooling branches and is supposed to simultaneously serve as a mixing chamber for the equalization of the temperature of the internal heat exchange fluid. Another heat exchanger of this general type is shown in Japanese patent document JP06317363A. Both of these designs also work well for their intended purpose but may be difficult to manufacture for the reasons above stated.

The present invention is intended to overcome one or more of the above problems.

SUMMARY OF THE INVENTION

It is the principal object of the invention to provide a new and improved serpentine, multiple pass heat exchanger. More specifically, it is an object of the invention to provide such a heat exchanger that provides counter-cross current flow of one heat exchange medium in relation to the flow of the other and which employs simple and inexpensive means to guide the fluid through multiple passes within the heat exchanger.

An exemplary embodiment of the invention achieves the foregoing object in a serpentine, multiple pass heat exchanger that include at least one flattened multiple port tube in serpentine configuration with a plurality of generally parallel runs to define at least three hydraulically separate flow paths. Fins extend between and are in thermal conducting relation with adjacent ones of the runs for each flow path. An inlet manifold is disposed on one end of the tube or tubes and is in fluid communication with the ports therein. An outlet manifold is on the opposite end of the tube or tubes and in fluid communication with the ports therein. One of the flow paths is adjacent to the back side of the heat exchanger through which a gas may exit and another of the flow paths is adjacent a front of side of the heat exchanger through which a gas may enter. A baffle is disposed in the outlet manifold and separates another flow path and one of the other flow paths from the remaining flow paths. The inlet manifold has an inlet port through which a fluid may enter the inlet manifold and is located adjacent the front side the heat exchanger. A partition extends both longitudinally and transversely within the inlet manifold to hydraulically separate the one flow path from the inlet port while connecting another flow path to at least one other flow path other than the one flow path.

As a consequence, a multiple pass, counter-cross current flow is provided in a structure wherein flow guidance within the heat exchanger is readily and inexpensively achieved through the use of a simple baffle and a simple partition.

In a preferred embodiment, the cross sectional area of the one flow path is different or greater than the cross sectional area of the other flow path.

In one embodiment, at least one other flow path is the another flow path.

One embodiment contemplates that at least one of the other flow paths comprises at least two said other flow paths and one of said other flow paths is the another flow path. The partition serves to connect the other flow path to the inlet port and connect, within the inlet manifold, the one of the other flow paths to at least the remaining flow paths.

Preferably, the remaining flow paths includes the other flow path.

In a preferred embodiment, the partition is defined by a longitudinal partition section extending longitudinally within the inlet manifold and terminating in a transverse partition section ending transversely within the inlet manifold and to the longitudinal partition at a location within the inlet manifold between the ends thereof.

In a preferred embodiment, the fins are common to all of the flow paths.

In one embodiment, each of the flow paths is defined by individual multiple port tubes aligned, in side by side relation. In another of the contemplated embodiments, each of the flow paths is defined by one or more ports in a single multiple port tube.

Other objects and advantages will become apparent from the following specification taken in connection with the accompanied drawings.

DESCRIPTION OF THE DRAWINGS

FIG. 6 is a schematic view of the heat exchanger showing flow there through;

DESCRIPTION OF THE PREFERRED EMBODIMENT

Figure 1:
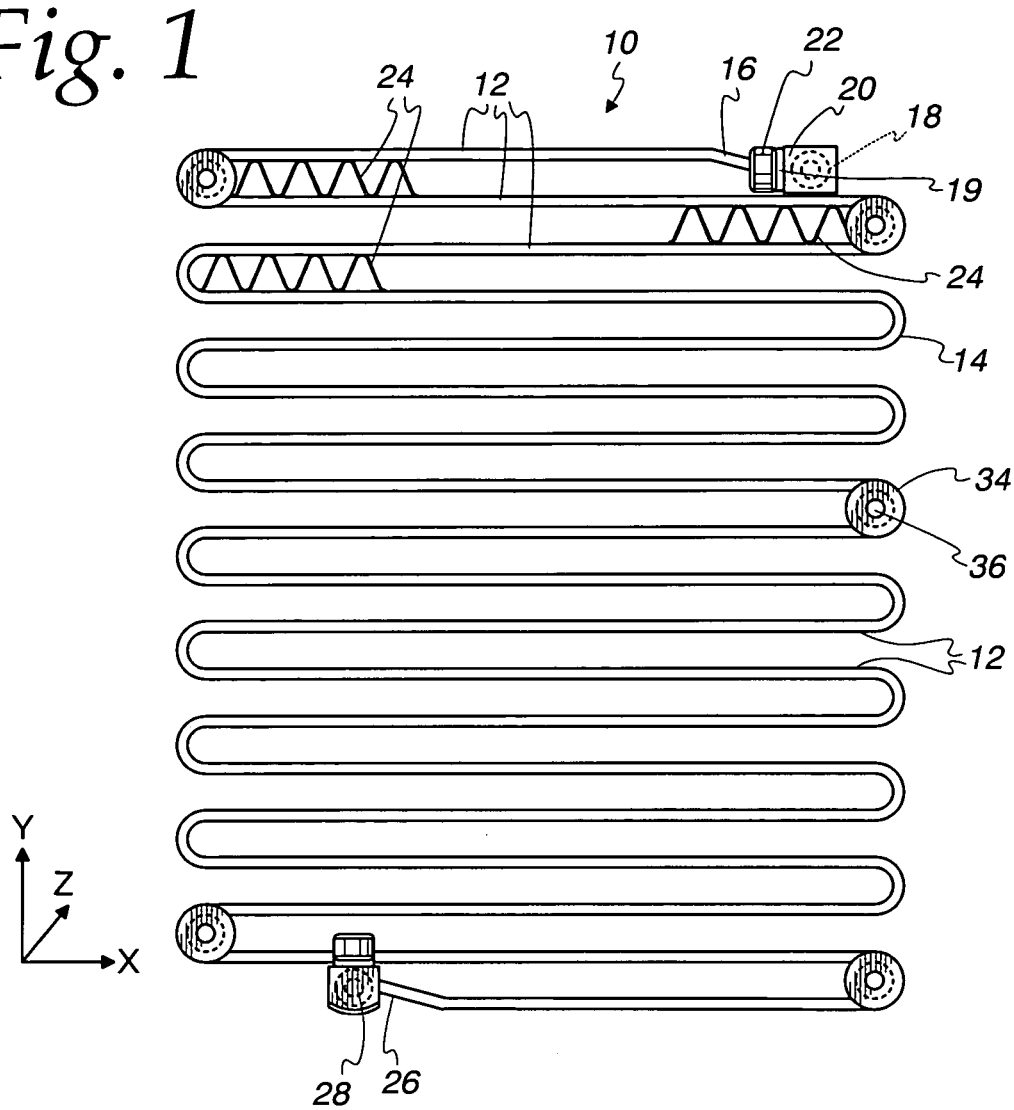
FIG. 1 is a front elevational view of an exemplary embodiment of the heat exchanger.

Exemplary embodiments of a heat exchanger made according to the invention are shown in the drawings and will be described herein in the context of two phase heat exchange, specifically, as a condenser for a refrigerant which may be employed in refrigeration systems (which include air conditioning systems). However, it is to be expressly understood that the invention is not so limited. For example, it can be used as an evaporator rather than as a condenser or even as a gas cooler in so called transcritical refrigerant systems. Further, the heat exchanger can be used in single phase systems where, for example, the heat exchange is gas/gas or gas/liquid with a gas or liquid flowing through the tubes of the heat exchanger and a gas, either for heating or cooling, flows in heat exchange relation through the heat exchanger from its front to its back. Consequently, no limitation to specific usages or specific heat exchange mediums are intended except in as so far as specified in the appended claims.

With the foregoing in mind, attention will now be directed to FIGS. 1–3 and 6 where a first embodiment of the invention is illustrated.

As seen in FIG. 1, the heat exchanger includes an elongated, flattened, multi-port tube, generally designated 10, folded upon itself in serpentine fashion to provide a plurality of generally parallel runs 12 which are connected by bends 14. At one end 16 of the tube 10, a cylindrical tube 18 is provided. The tube 18 is an inlet manifold and has an elongated slit 19 in it to receive the end 16 thereby establish fluid communication between the ports in the tube 10 and the interior of the inlet manifold 18. At one end, a fitting block 20 by which the heat exchanger may be connected into a system handling a fluid to be heated or cooled within the heat exchanger.

Between adjacent runs 12 of the tube, conventional serpentine fins 24 are located. The fins 24 are bonded as by brazing or soldering to adjacent ones of the runs 12.

At the end 26 of the tube 10, a slotted, cylindrical tubular outlet manifold 28 is located. The end 26 is received in the slot (not shown) of the outlet manifold 28. At one end, the outlet manifold 28 may have a fitting block 30 provided with an outlet port 32.

Desirably, at various ones of the bends 14, elastomeric grommets 34 having through holes 36 are provided. By providing fasteners extending through the through holes 36, the heat exchanger may be mounted as desired.

Figure 2:
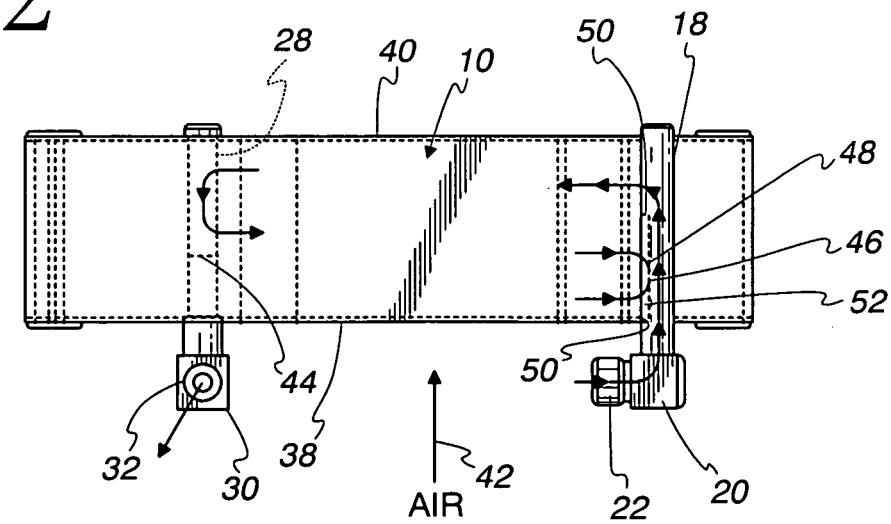
FIG. 2 is a plan view of the heat exchanger.
Figure 3:
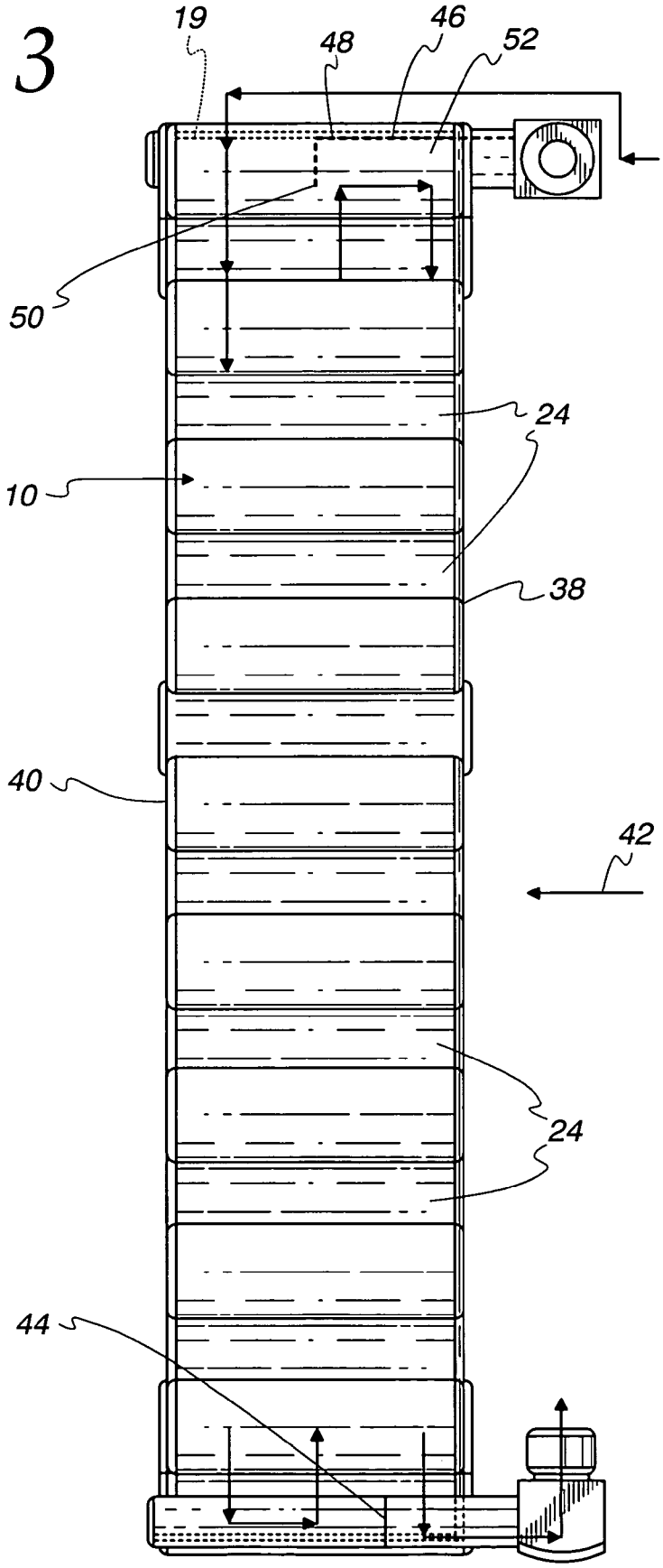
FIG. 3 is a side elevation of the exchanger.
Figure 4:
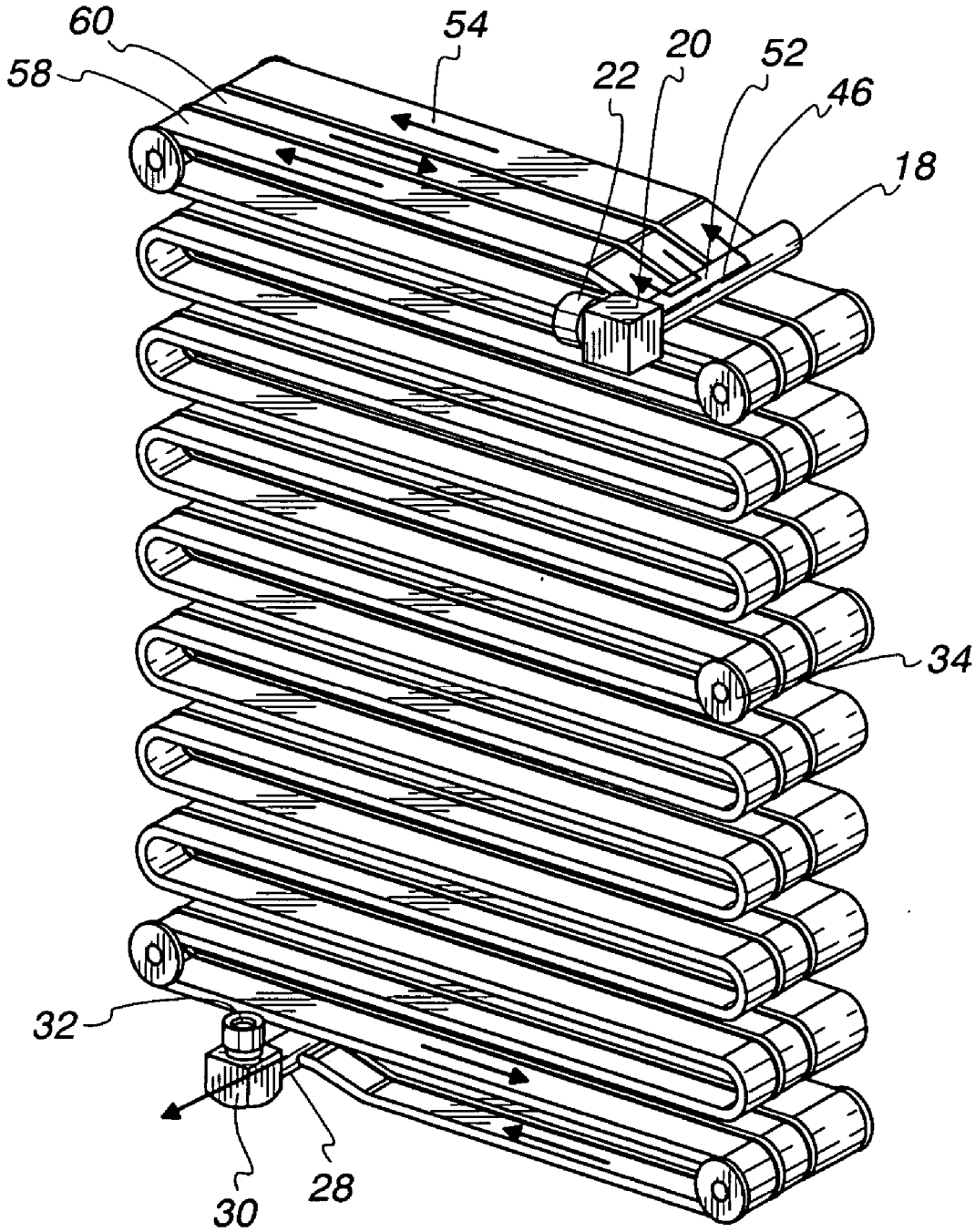
FIG. 4 is a perspective view of a modified embodiment of the invention.
Figure 5:
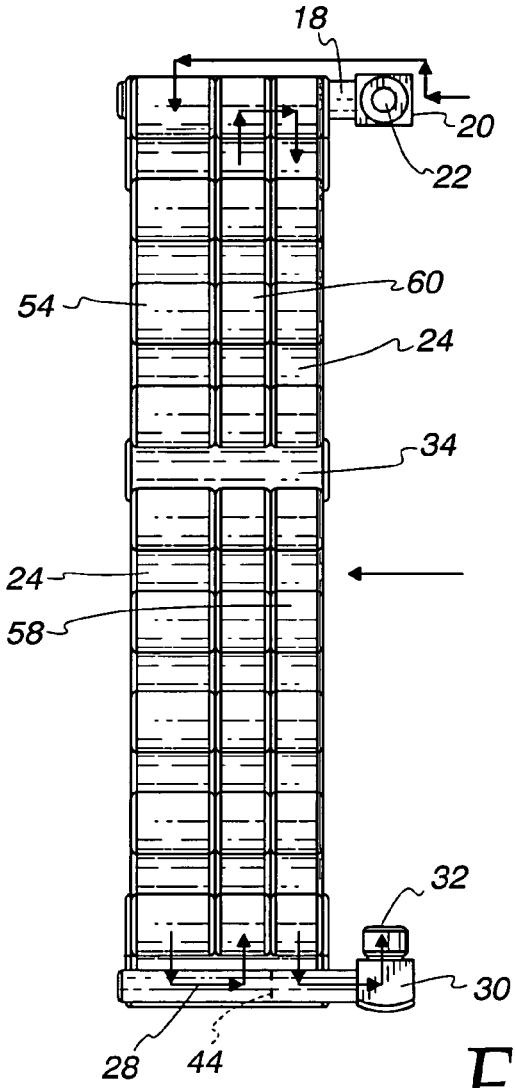
FIG. 5 is a side elevation of the heat exchanger illustrated in FIG. 4.

As best seen in FIGS. 2 and 3, the heat exchanger includes a front side 38 and rear side 40. The direction of gas flow through the heat exchanger, typically air, is indicated by an arrow 42.

As is apparent from FIGS. 2 and 3, the embodiment of FIGS. 1–3 employs a single multi-port tube 10 that extends between the front and back 38 and 40, respectively.

With reference to FIGS. 2 and 3, a baffle 44 extends across and blocks the outlet manifold 28 at a location to be described in greater detail hereinafter.

In addition, a partition, generally designated 46, is located within the inlet manifold 18. The partition 46 includes a longitudinal partition section 48 and transverse partition section 50 at one or both ends of the longitudinal partition section 28. The longitudinal partition section 48 extends longitudinally within the inlet manifold 18 and terminates in one of the transverse partition sections 50 located at a position between the ends of the inlet manifold 18. All of the foregoing components are brazed or soldered together. In the case of the serpentine fins 24, this promotes good heat transfer contact between the fins and the tube 10 as is well known. It also provides for sealing of the ends 16, 26 in the respective manifolds 18, 28, and specifically the slots therein to prevent leakage. Furthermore, it provides that the baffle 44 will completely block flow through the outlet manifold 28 at the location at which the baffle 44 is located. Similarly, it assures that the partition 46, and sections 48 and 50 thereof, provide a space 52 that isolates the flow through the inlet port 22 from flow through the ports of the multi-port tube 10 that are closest to the front 38 of the heat exchanger.

Figure 6:
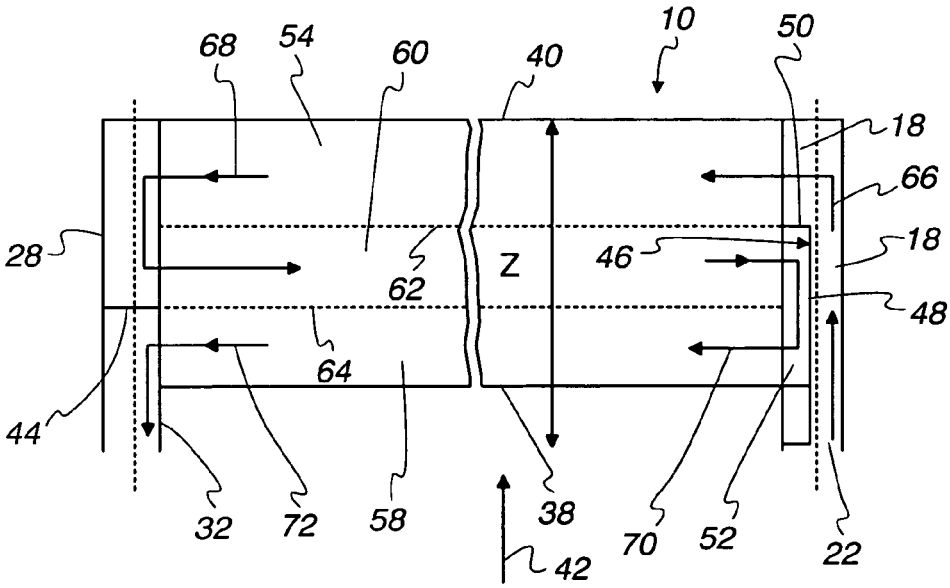
Figure 7:
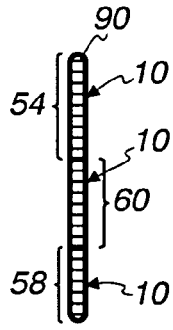
FIG. 7 is a somewhat schematic, sectional view of a multiple port, flat tube used in the heat exchanger.

In the embodiment illustrated in FIGS. 1–3, provision is made for three passes. Referring to FIG. 6, a first pass 54 is located immediately adjacent the back or rear 40 of the heat exchanger while a last path 56 is located immediately adjacent the front 38 of the heat exchanger. An intermediate path 60 is located between the first path 54 and the last path 58. The baffle 44 and partition 48 serve to define the passes. As seen in FIG. 6, the transverse partition 50 located between the ends of the inlet manifold 18 is located at the boundary shown schematically at 62 between the first path 54 and the intermediate path 60 while the baffle 44 is located at the boundary shown schematically at 64 between the intermediate path 60 and the last path 58. These locations are selected to be at the space between adjacent ports of the multi-port tube 10 and as a consequence, flow entering the inlet port 22 flows in the direction of an arrow 66 past the partition 46 to the first path 50 where at it will flow to the outlet manifold 32. However, it will be blocked from flowing to the outlet port 32 by the baffle 40 and thus be directed through the intermediate path 60 as shown by an arrow 68. The flow will emerge from the intermediate path 60 to be directed against the partition section 48 which confines the same and redirects it as shown by an arrow 70 to the last path 58. From there, flow reenters the outlet manifold 28 and travels to the outlet port 32 as indicated by an arrow 72.

That is to say, flow is directed through the first, intermediate and last passes 54, 60, and 58 in that sequence to provide three passes with a first pass being at the rear 40 of the heat exchanger and the last pass being at the front 38 of the heat exchanger. Thus, the back to front flow of the fluid within the tube 10 is counter to the flow of gas indicated by the arrow 42 from the front 38 to the back 40 of the heat exchanger. In addition, because the flow of within the tube 10 is crossing the path of air flow, a cross flow is established, thereby providing a counter-cross flow pattern which those skilled in the art will immediate recognize as maximizing heat exchange efficiency in this type of heat exchanger. It will be particularly observed that the partition 46 is easily inserted in the manifold 18 prior to the application of the fitting block 20 as a simple operation. The longitudinal partition section 48 has the same dimension from side to side as the internal diameter of the manifold 18 while the transverse section 50 may be semi-circular having a radius equal to the internal radius of the manifold 18. Thus, is only necessary to provide appropriate braze clad or solder clad material on the partition 46 and insert the same to the desired location within the manifold 18 to achieve this desired flow pattern.

Figure 8:
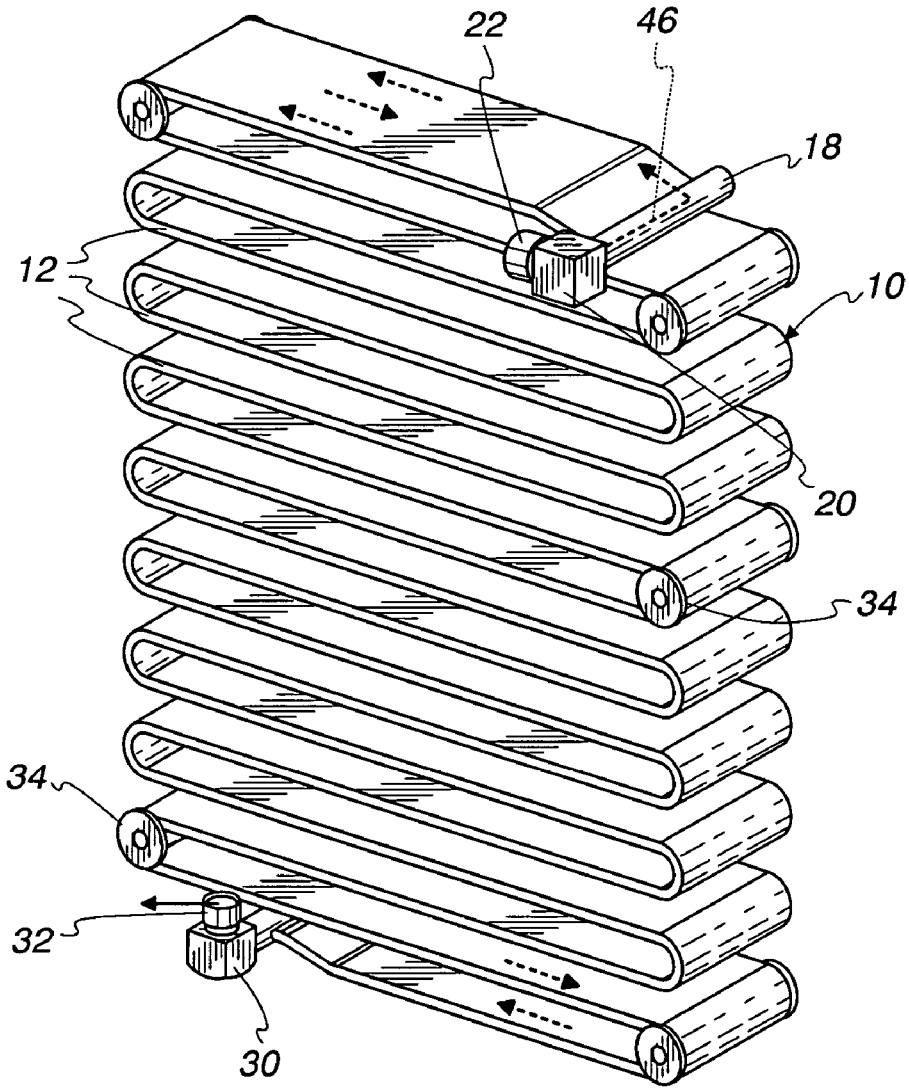
FIG. 8 is a perspective view of the embodiment illustrated in FIGS. 1–3.
Figure 9:
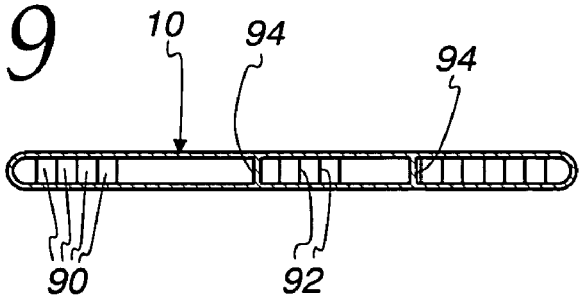
FIG. 9 is a sectional view of a multiple port, flattened tube.

A perspective view of the embodiment of FIGS. 1–3 is illustrated in FIG. 8. FIG. 9 illustrates a preferred cross section of the tube 10 used in the embodiment of FIGS. 1–3. Various ports 90 are shown as being separated by internal walls 92 of relatively minimal thickness. On the other hand, relatively thick walls 94 may be employed as the boundaries 62, 64 separating the various passes. The use of relatively thick walls is preferred at these locations to ensure that a good seal with the baffle 44 or the partition 46 is achieved. Elsewhere, the partitions 92 need only be of sufficient thickness as to provide the desired pressure resistance and transfer of heat to the exterior walls of the tube 10. Generally speaking, it will be desirable to make the walls as thin as possible commensurate with these goals to minimize weight and realize a material savings.

From the foregoing, those skilled in the art will appreciate that a highly efficient multi-pass serpentine heat exchanger with the efficient counter-cross flow feature is provided. Manufacture is simple, particularly in terms of defining the space 52 which isolates the last two passes in the embodiments illustrated from fluid entering the inlet port 22. Of course, more than three passes may be employed simply by utilizing an additional one or ones of the baffles 44 at the desired locations and by placing one or more additional transverse partition sections 50 at a desired location between the two positions illustrated in FIG. 2.

The invention claimed is:

1. A serpentine, multiple pass heat exchanger comprising:

at least one flattened multiple port tubes in a serpentine configuration with a plurality of generally parallel runs defining at least three hydraulically separate flow paths;

fins extending between and in thermal conducting relation with adjacent ones of said runs for each flow path;

an inlet manifold on one end of said tube(s) and in fluid communication with the ports therein; and an outlet manifold on an opposite end of said tube(s) and in fluid communication with the ports therein;

the cross sectional area of one of said flow paths being greater than the cross sectional area of another of said flow paths with said one flow path being adjacent a back side of said heat exchanger through which a coolant may exit and said another flow path being adjacent a front side of said heat exchanger through which a coolant may enter;

a baffle in said outlet manifold separating said another flow path and one of the other of said flow paths from the remaining flow path(s);

said inlet manifold having inlet port through which a fluid may enter said inlet manifold and located adjacent said front side of said heat exchanger and a partition extending both longitudinally and transversely within said inlet manifold to hydraulically separate said one flow path from said inlet port while connecting said another flow path to at least one other flow path other than said one flow path.

2. The serpentine multiple pass heat exchanger of claim 1 wherein said at least one other flow path is said another flow path.

3. The serpentine multiple pass heat exchanger of claim 1 wherein said at least one other flow path comprises at least two said other flow paths and one of said other flow paths is said another flow path, and wherein said partition serves to connect said another flow path to said inlet port and connect, within said inlet manifold, said one of said other flow paths to said remaining flow path(s).

4. The serpentine multiple pass heat exchanger of claim 3 wherein said remaining flow path(s) is said another flow path.

5. The serpentine multiple pass heat exchanger of claim 1 wherein said partition is defined by a longitudinal partition section extending longitudinally within said inlet manifold and terminating in a transverse partition section extending transversely to said inlet manifold and said longitudinal partition at a location within said inlet manifold between the ends thereof.

6. The serpentine multiple pass heat exchanger of claim 1 wherein said fins are common to all of said flow paths.

7. The serpentine multiple pass heat exchanger of claim 1 wherein each of said flow paths is defined by an individual multiple port tube, the individual tubes being in aligned, side by side relation.

8. The serpentine multiple pass heat exchanger of claim 1 wherein each of said flow paths is defined by one or more ports in a single multiple port tube.

9. A serpentine, multiple pass heat exchanger comprising:

at least one flattened multiple port tubes in a serpentine configuration with a plurality of generally parallel runs defining at least three hydraulically separate flow paths;

fins extending between and in thermal conducting relation with adjacent ones of said runs for each flow path;

an inlet manifold on one end of said tube(s) and in fluid communication with the ports therein; and an outlet manifold on an opposite end of said tube(s) and in fluid communication with the ports therein;

one of said flow paths being adjacent a back side of said heat exchanger through which a coolant may exit and another of said flow paths being adjacent a front side of side heat exchanger through which a coolant may enter;

a baffle in said outlet manifold separating said another flow path and one of the other of said flow paths from the remaining flow path(s);

said inlet manifold having inlet port through which a fluid may enter said inlet manifold and located adjacent said front side of said heat exchanger and a partition extending both longitudinally and transversely within said inlet manifold to hydraulically separate said one flow path from said inlet port while connecting said another flow path to at least one other flow path other than said one flow path.

10. A serpentine, multiple pass heat exchanger comprising:

at least one flattened multiple port tube in a serpentine configuration with a plurality of generally parallel runs defining at least three hydraulically separate flow paths;

fins extending between and in thermal conducting relation with adjacent ones of said runs for each flow path;

a tubular inlet manifold having slit(s) receiving one end of said tube(s) to be in fluid communication with the ports therein; and a tubular outlet manifold having a slit(s) receiving an opposite end of said tube(s) to be in fluid communication with the ports therein;

the cross sectional area of one of said flow paths being different from the cross sectional area of another of another of said flow paths with said one flow path being adjacent a back side of said heat exchanger through which a coolant may exit and said another said flow path being adjacent a front side of said heat exchanger through which a coolant may enter;

a baffle in said tubular outlet manifold separating one of the other of said flow paths from said another flow path;

said tubular inlet manifold having an inlet port through which fluid may enter said tubular inlet manifold and located adjacent said front side of said heat exchanger, a longitudinal partition section extending longitudinally within said inlet manifold and terminating within said inlet manifold, between therein the ends thereof, with a transverse partition section within said inlet manifold serving to hydraulically separate all but one said flow path from said inlet port while connecting said another flow path to at least one other flow path other than said one flow path.

* * * * *